United States Patent [19]

Matuki

[11] Patent Number: 4,554,703

[45] Date of Patent: Nov. 26, 1985

[54] MAGNETIC ERASER DUST COLLECTOR

[75] Inventor: Shouzo Matuki, Takasaki, Japan

[73] Assignee: Taiyo Yuden Co., Ltd., Tokyo, Japan

[21] Appl. No.: 572,184

[22] Filed: Jan. 19, 1984

[30] Foreign Application Priority Data

| | | | |
|---|---|---|---|
| Feb. 10, 1983 | [JP] | Japan | 58-19176[U] |
| May 31, 1983 | [JP] | Japan | 58-82646[U] |
| Jun. 9, 1983 | [JP] | Japan | 58-88697[U] |
| Jun. 9, 1983 | [JP] | Japan | 58-88698[U] |

[51] Int. Cl.[4] ..... B43L 19/00

[52] U.S. Cl. ..... 15/424; 7/901; 209/215

[58] Field of Search ..... 15/424–426, 15/433, 434, 105, 111; 335/219; 209/215; 7/901; 294/65.5

[56] References Cited

U.S. PATENT DOCUMENTS

| | | | |
|---|---|---|---|
| 2,417,762 | 3/1947 | Koller | 7/901 |
| 2,528,709 | 11/1950 | Raymond et al. | 15/424 X |
| 2,733,948 | 2/1956 | Russell | 294/65.5 |
| 2,976,075 | 3/1961 | Budreck | 294/65.5 |
| 3,105,257 | 10/1963 | Blagden | 15/105 |

FOREIGN PATENT DOCUMENTS

| | | | |
|---|---|---|---|
| 1119582 | 6/1956 | France | 294/65.5 |

*Primary Examiner*—Edward L. Roberts

*Attorney, Agent, or Firm*—Woodcock Washburn Kurtz Mackiewicz & Norris

[57] ABSTRACT

A device for use with an eraser of a rubber composition having magnetic particles dispersed therein. The device has a permanent magnet for attracting the magnetic dust created by use of the eraser. For the ready removal of the collected dust the device further comprises a shield normally enclosing the magnet. When held close to or in direct contact with a dust collecting wall forming a part of the shield, the magnet attracts eraser dust therethrough. The eraser dust attached to the dust collecting wall can be readily released, as into a suitable receptacle such as a trash can, as the magnet is moved away from the dust collecting wall as by being pulled out of the shield. The device may incorporate a magnetic eraser to provide a convenient eraser/dust collector combination, as in some embodiments disclosed herein. Additional embodiments suggest the combined use of a brush for collecting eraser dust, and the provision of an open space for confining the collected dust on the dust collecting wall of the shield.

15 Claims, 25 Drawing Figures

MAGNETIC ERASER DUST COLLECTOR

BACKGROUND OF THE INVENTION

This invention relates to eraser dust collectors, and more specifically to a device for readily collecting and discarding the dust created by use of a magnetic eraser, that is, an eraser of a rubber composition having magnetic particles uniformly dispersed therein. The magnetic eraser dust collector in accordance with the invention may, or may not, incorporate a magnetic eraser.

The rubber eraser is perhaps the most popular tool for erasing pencil and other marks on paper or other surfaces. It has a problem, however, that has not so far found a truly satisfactory solution. The problem is the disposal of the dust produced as the eraser is rubbed against a desired surface. The eraser dust has usually be removed by brushing, wiping, blowing, etc. These usual methods do not assure complete dust removal. Further the dust is mostly merely scattered away from the surface, instead of being collected, thus soiling the neighboring surfaces.

A practical solution to the problem is the magnetic eraser. The magnetic particles contained in the eraser are so fine and so uniformly dispersed therein that the dust particles created thereby are sufficiently magnetic to be attracted by a permanent magnet. The direct magnetic attraction of the eraser dust gives rise to a difficulty, however, in removing the collected dust from the magnet.

SUMMARY OF THE INVENTION

The present invention makes possible the efficient, thorough collection of magnetic eraser dust and the ready casting of the collected dust as into a trash can or like receptacle.

Stated briefly, the invention provides a device for collecting magnetic eraser dust, comprising a permanent magnet for attracting magnetic eraser dust, and a shield normally enclosing the magnet to prevent direct attachment of the magnetic eraser dust thereto. The shield includes a dust collecting wall having such a thickness that the magnetic can attract the eraser dust therethrough. Further the magnet is movable relative to the shield between a working position in which the magnet lies close to or in contact with the dust collecting wall for attracting eraser dust therethrough, with the consequent adhesion of the eraser dust to the wall, and a retracted position away from the wall for releasing the collected dust therefrom.

The shield takes the form of a box, with one end closed and another end open, in one embodiment of the invention. The permanent magnet when bottomed against the closed end of the boxlike shield can attract magnetic eraser dust therethrough, with the closed end of the shield serving as the aforesaid dust collecting wall. The eraser dust that has attached to this wall can be readily released, as for letting it fall into a trash can or the like, simply by pulling the magnet out of the shield or by moving the magnet away from its closed end to a required degree.

The device of this invnention may incorporate a magnetic eraser, as by attaching it to the magnet, to provide an integrated eraser/dust collector combination. Some embodiments disclosed herein include an eraser whereas the others do not. Basically, therefore, the magnetic eraser is not considered an essential component of the device in accordance with the invention.

The above and other features and advantages of the present invention and the manner of attaining them will become more clearly apparent, and the invention itself will best be understood, from a study of the following description and appended claims, with reference had to the attached drawings showing some preferable embodiments of the invention.

DESCRIPTION OF THE PREFERRED EMBODIMENTS

Figure 1:
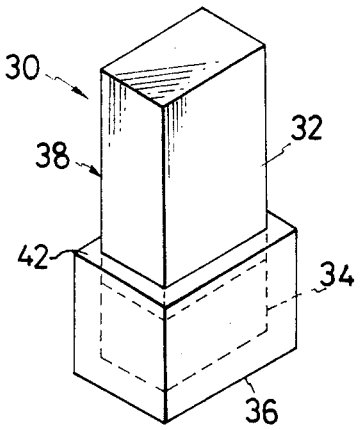
FIG. 1 shows in perspective the eraser/dust collector combination constructed in accordance with the novel concepts of this invention.

FIGS. 1 through 4 illustrate the invention as embodied in an eraser/dust collector combination generally referenced 30. It comprises a magnetic eraser 32, a permanent magnet 34 integrally attached to the eraser, and a shield 36 normally enclosing the magnet and part of the eraser. Shown to be in the familiar shape of a block, the eraser 32 is of a generally rubber composition having fine magnetic particles uniformly dispersed therein. The magnetic particles may be those of iron, nickel, soft ferrite material, etc. Such magnetic particles find their way into the dust particles into which the eraser disintegrates on being rubbed against paper or other surface, so that the eraser dust can be attracted magnetically.

The permanent magnet 34 is also shown to be in the shape of a block, attached to one end of the eraser 32 by means of an adhesive. Adhesive layers are not shown in these and all the subsequent drawings for simplicity. So combined, the eraser 32 and magnet 34 make up an eraser/magnet assembly generally designated 38.

Figure 2:
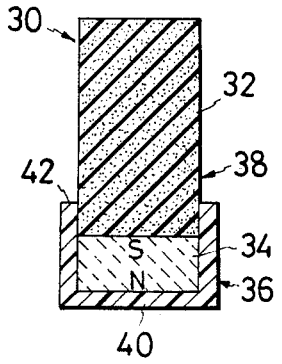
FIG. 2 is a longitudinal section through the eraser/-dust collector combination of FIG. 1.
Figure 3:
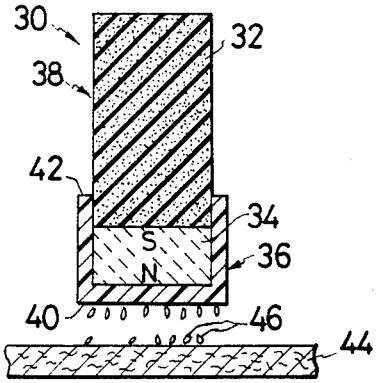
FIG. 3 is a view similar to FIG. 2 but explanatory of the way the device collects magnetic eraser dust from a desired surface.
Figure 4:
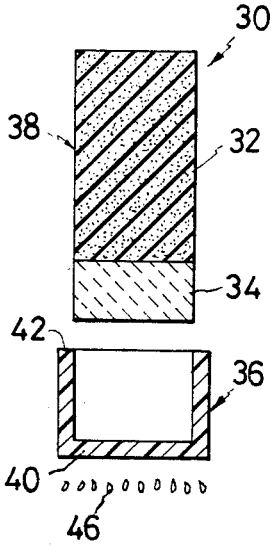
FIG. 4 is also a view similar to FIG. 2 but explanatory of the way the collected eraser dust is released from the device.

The shield 36 is shown as being boxlike in shape. Preferably molded of plastics material, the boxlike shield 36 has a closed end 40 and open end 42. The eraser/magnet assembly 38 is normally received in the shield 36, with the magnet 34 bottomed against its closed end 40 as best seen in FIGS. 2 and 3. The eraser 32 mostly projects out of the shield 36 even when the eraser/magnet assembly 38 if fully received therein. The eraser/magnet assembly 38 is forcibly movable relative to the shield 36 between a working position of FIGS. 1 through 3 and a retracted position of FIG. 4. In the working position the magnet 34 is held against the closed end 40 of the shield 36 for attracting eraser dust therethrough. This closed end of the shield is herein termed the dust collecting wall as the eraser dust is magnetically attached to its outer surface. The thickness of the dust collecting wall 40 must of course be so determined as to allow the magnet 34 to attract eraser dust therethrough. In the retracted position, on the other hand, the eraser/magnet assembly 38 is shown out of engagement with the shield 36, allowing the collected eraser dust to fall from the dust collecting wall 40.

The shield 36 may not necessarily be a plastic molding. The intended functions of the shield are attainable if it is made of other nonmagnetic or mild magnetic substances.

Such being the construction of the eraser/dust collector combination 30, its eraser 32 may be used in the usual manner for erasing pencil or other marks on paper or like surface 44, FIG. 3. For collecting the magnetic dust particles 46 created by the eraser 32, the shielded permanent magnet 34 of the eraser/dust collector combination 30 may be held opposite to the surface 46 and moved thereover, causing the eraser dust to attach magnetically to the dust collecting walls 40 of the shield 36. Then, over a suitable receptacle such as a trash can, the eraser/magnet assembly 38 may be moved to the retracted position away from the dust collecting wall 40 of the shield 36, as by pulling the eraser/magnet assembly out of the shield as in FIG. 4. The dust collecting wall 40 will then release the dust particles 46, letting them fall into the receptacle.

The eraser/dust collector combination 30 gains the following advantages:

1. The magnetic attraction of eraser dust makes possible the positive and efficient cleaning of the surface.

2. The magnetic collection of eraser dust onto the dust collecting wall 40 of the shield 36, instead of onto the magnet 34 itself, allows the ready release of the collected dust.

3. Dust collection is easy as the magnet 34 is fully engaged in the boxlike shield 36.

4. The magnet 34 is not to be lost easily as it is integrally combined with the eraser 32.

Second Form

Figure 6:
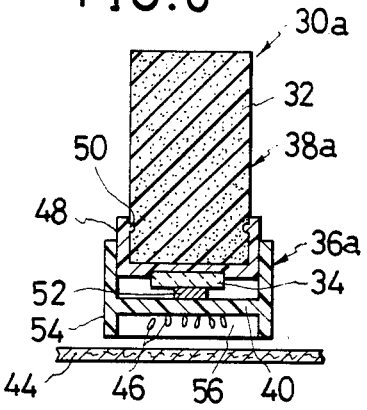
FIG. 6 is a longitudinal section through the eraser/-dust collector combination of FIG. 5, the view being explanatory of the way the device collects magnetic eraser dust.
Figure 7:
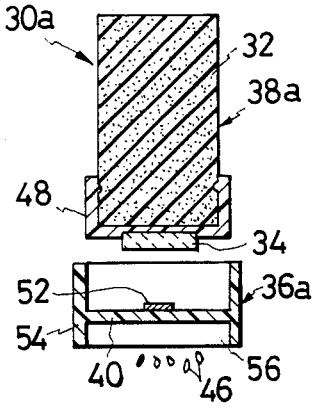
FIG. 7 is a view similar to FIG. 6 but explanatory of the way the collected eraser dust is released from the device.
Figure 8:
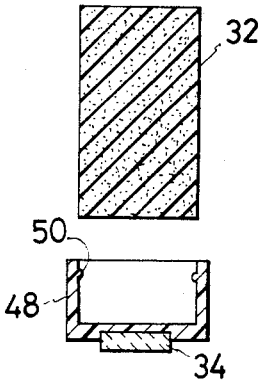
FIG. 8 is a sectional view showing the eraser detached from its holder in the eraser/dust collector combination of FIG. 5.

FIGS. 5 through 8 also illustrate the invention as embodied in an eraser/dust collector combination 30*a* of slightly modified construction. The modified device has an eraser holder 48 of boxlike shape, with one end closed and another end open, enclosing part of the eraser 32. As best seen in FIG. 8, the eraser holder 48 has ribs 50 formed on its inner surfaces, in the adjacency of its open end, to engage the eraser 32 and hence to firmly retain the same. The permanent magnet 34 is immovably mounted exteriorly on the closed end of the eraser holder 48, as by means of an adhesive, to make up an eraser/magnet assembly 38*a* in combination therewith and with the eraser 32.

The eraser holder 48 is slidably received in a boxlike shield 36*a* of modified shape so as to leave the eraser 32 projecting therefrom. When in the working position of FIG. 6, the magnet 34 is held against a piece of magnetic material 52 such as stainless steel immovably mounted centrally on the inner surface of the dust collecting wall 40 of the shield as by means of an adhesive.

The boxlike shield 36*a* is formed to include a set of rims 54 projecting from the marginal edges of its dust collecting wall 40 to provide a confined space 56 for accommodating the collected eraser dust.

Figure 5:
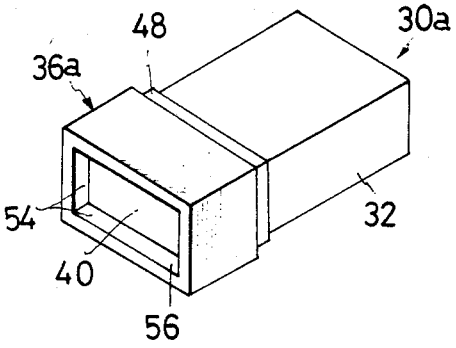
FIG. 5 shows in perspective another preferred example of eraser/dust collector combination in accordance with the invention.

The eraser/magnet assembly 38*a* may be held engaged with the shield 36*a* as in FIGS. 5 and 6, with the magnet 34 in firm magnetic contact with the magnetic piece 52, in the use of the eraser/dust collector combination 30*a* for erasing pencil or other marks from the surface 14. For collecting the magnetic eraser dust particles 46 the eraser/dust collector combination 30*a* may be moved over the surface 44, with the dust collecting wall 40 of the shield 36*a* held opposite to the surface. The magnet 34 will attract the eraser dust through the magnetic piece 52 and dust collecting wall, causing the dust to attach to the dust collecting wall as in FIG. 6.

For releasing the collected eraser dust the eraser/-magnet assembly 38*a* may be pulled out of the shield 36*a*, as in FIG. 7, against the attractive force exerted by the magnet 34 on the magnetic piece 52. The eraser/-magnet assembly 38*a* may be reinserted in the shield 36*a* following the release of the collected eraser dust.

The eraser/dust collector combination 30*a* offers the same advantages as those listed above in conjunction with the device 30 of FIGS. 1 through 4. Additional advantages are:

1. The shield 36*a* with the magnetic piece 52 secured thereto is held magnetically attached to the eraser/magnet assembly 38*a* for convenience in both erasing and dust collection.

2. There is little likelihood of either the shield 36*a* or the eraser/magnet assembly 38*a* becoming lost.

3. The positive positional relationship between magnet 34 and shield 36*a* affords stable dust collection.

4. The collected eraser dust is confined within the space 56 bounded by the rims 54 and so is not to fall readily from the shield 36*a* even if the user inadvertently strikes the device against some external object.

5. The eraser 32 is readily removable from the holder 48, as in FIG. 8, as for replacement with a new one when worn out.

Third Form

Figure 9:
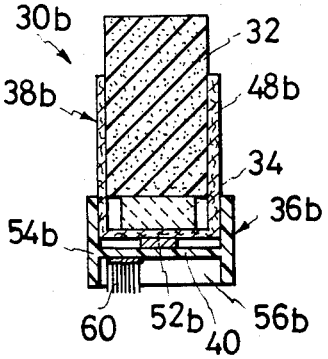
FIG. 9 is a longitudinal section through a further preferred example of eraser/dust collector combination in accordance with the invention.

Still another eraser/dust collector combination 30*b* of FIG. 9 has an eraser holder 48*b* of flexible paper or like material in the form of a box, closed at one end and open at the other and having a greater end-to-end longitudinal dimension than the eraser holder 48 of the preceding embodiment. In this embodiment the holder 48*b* receives not only the eraser 32 but also the permanent magnet 34, with the latter held against the closed end of the eraser holder and with the eraser partly projecting therefrom. The magnet 34 is secured to the eraser holder 48*b* as by means of an adhesive. Containing magnetic particles, the eraser 32 is magnetically attracted by the magnet 34 and so is firmly retained in the eraser holder 48*b* even though the eraser makes a somewhat loose fit with the holder. The eraser 32, magnet 34, and holder 48*b* constitute an eraser/magnet assembly 38*b*.

The eraser/magnet assembly 38*b* is inserted, with the holder 48*b* foremost, in a boxlike shield 36*b* having the dust collecting wall 40. A piece of magnetic material 52*b* is attached centrally to the inside surface of the dust collecting wall 40 as by means of an adhesive. Attracted by the magnet 34 via the closed end of the holder 48*b*, the magnetic piece 52*b* serves to positively hold the eraser/magnet assembly 38*b* engaged in the shield 36*b*.

Like the shield 36*a* of the preceding embodiment the shield 36*b* has a set of marginal rims 54*b* bounding a space 56*b* for accommodating the collected eraser dust.

This embodiment further features a brush 60 mounted exteriorly on the dust collecting wall 40 of the shield 36*b* to expedite the collection of eraser dust. The brush 60 comprises a mass of bristles set into a cloth back which is secured to the outside surface of the dust collecting wall 40 as by means of an adhesive. Preferably, and as shown, the brush 60 may occupy a relatively small part of the dust collecting wall surface, offset from its center, so as not to interfere with the collection of eraser dust onto the wall.

Thus, for collecting the magnetic dust created by use of the eraser 32 by the eraser/dust collector combination 30*b*, the brush 60 may be swept over the desired surface to facilitate the attraction of the dust by the magnet 34 via the holder 48*b*, magnetic piece 52*b*, and dust collecting wall 40. The collected dust will be released as the eraser/magnet assembly 38*b* is pulled out of the shield 36*b* against the attractive force exerted by the magnet 34 on the magnetic piece 52*b*.

A pronounced advantage of this embodiment is the added use of the brush 60 for more efficient dust collection. Other advantages are as set forth previously in connection with the above disclosed embodiments.

Fourth Form

Figure 10:
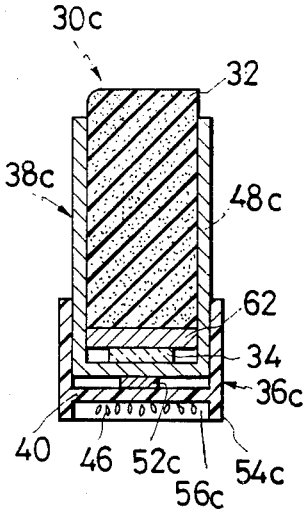
FIG. 10 is a longitudinal section through a further preferred example of eraser/dust collector combination in accordance with the invention.
Figure 11:
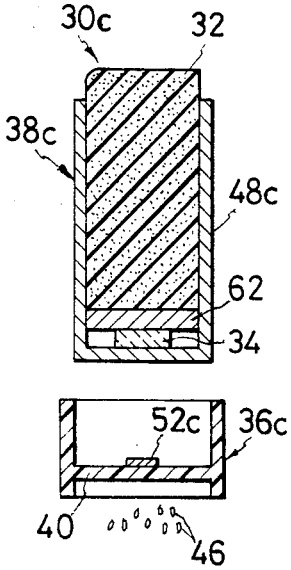
FIG. 11 is a view similar to FIG. 10 but explanatory of the way the collected eraser dust is released from the device.
Figure 12:
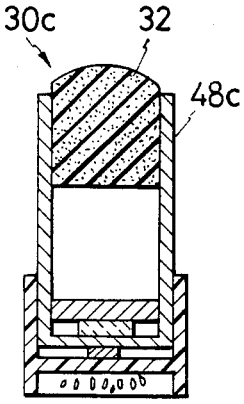
FIG. 12 is also a view similar to FIG. 10 but showing the eraser partly spent by use and pulled out of its holder for further use.

In FIGS. 10 through 12 is shown a further eraser/-dust collector combination 30*c* embodying the principles of the invention. This device has a boxlike eraser holder 48*c* of flexible paper or like material receiving not only the eraser 32 but also the permanent magnet 34 and, additionally, a piece of magnetic material 62 to provide an eraser/magnet assembly 38*c*. Both magnet 34 and magnetic piece 62 are secured to the closed end of the holder 48*c*, and the eraser 32 is held against the magnetic piece as in FIGS. 10 and 11. Disposed in direct contact with the magnet 34, the magnetic piece 62 serves to substantially increase its thickness, thus lessening the adverse effect of the demagnetizing force on dust collection.

The eraser/magnet assembly 38*c* is normally engaged in a boxlike shield 36*c* which is shown to be indentical with the shield 36*a* of FIGS. 5 through 7. Held fast against the inside surface of the dust collecting wall 40 of the shield 36*c*, another piece of magnetic material 52*c* coacts with the magnet 34 to positively hold the eraser/magnet assembly 38*c* engaged in the shield 36*c*.

The eraser/dust collector combination 30*c* is to be moved over a desired surface for magnetic eraser dust collection in the state of FIG. 10. The magnet 34 with the magnetic piece 62 in direct contact therewith will attract the dust particles 46 through the closed end of the holder 48*c*, the magnetic piece 52*c*, and the dust collecting wall 40, thereby causing attachment of the dust to the dust collecting wall. The collected dust is of course confined in the space 56*c* bounded by the marginal rims 54*c* of the dust collecting wall 40. The disengagement of the eraser/magnet assembly 38*c* from the shield 36*c* as in FIG. 11 results in the release of the collected dust from the dust collecting wall 40.

It will be noted from FIGS. 10 and 11 that the holder 48*c* encloses most of the eraser 32. When worn from use, the eraser 32 may be pulled out from within the holder 48*c* to an extent necessary for erasure, as depicted in FIG. 12. Alternatively the holder 48*c* may be cut short to expose required part of the eraser 32.

Fifth Form

Figure 13:
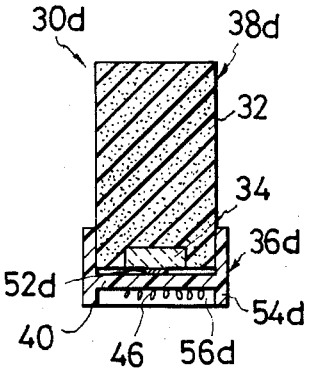
FIG. 13 is a longitudinal section through a further example of eraser/dust collector combination in accordance with the invention.
Figure 14:
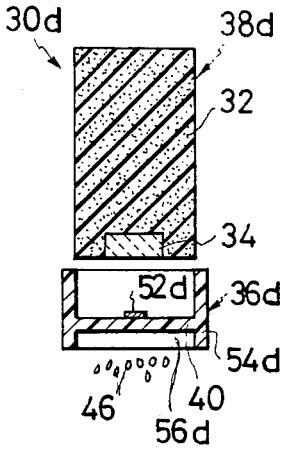
FIG. 14 is a view similar to FIG. 13 but explanatory of the way the collected eraser dust is released from the device.
Figure 15:
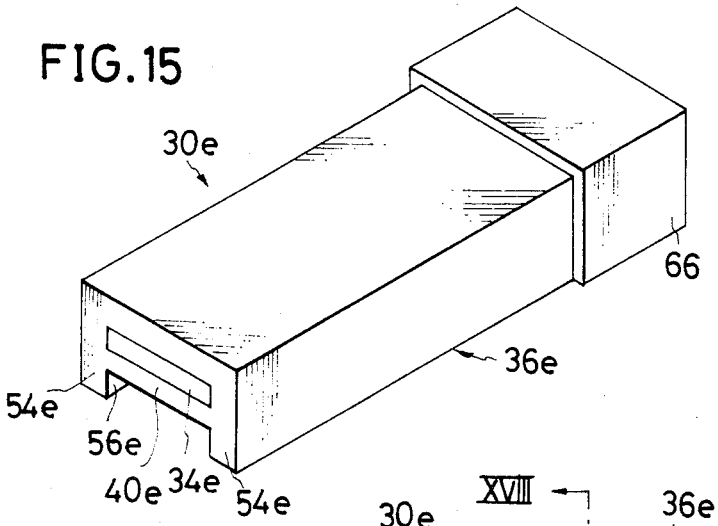
FIG. 15 shows in perspective form of the magnetic eraser dust collector, not including an eraser, constructed in accordance with the principles of the invention.
Figure 16:
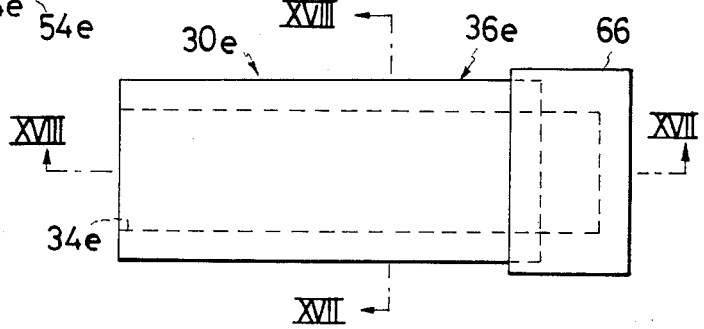
FIG. 16 is an elevation of the dust collector of FIG. 15.

In a further eraser/dust collector combination 30*d* of FIGS. 13 and 14 the eraser 32 has the permanent magnet 34 embedded in one end thereof to provide an eraser/magnet assembly 38*d*. This assembly is normally engaged in a boxlike shield 36*d*, identical with the shield 36*a* of FIGS. 5 through 7, with the magnet 34 held against the dust collecting wall 40 via a piece of magnetic material 52*d* secured to the wall. Attracted by the magnet 34, the magnetic piece 52*d* serves to retain the eraser/magnet assembly 38*d* in engagement with the shield 36*d*. The shield is formed to include a set of marginal rims 54*d* bounding a space 56*d* for accommodating the collected eraser dust.

The manner of operation of the eraser/dust collector 30*d* for collecting and releasing the magnetic eraser dust 46 will be apparent from the description of the foregoing embodiments and from an inspection of FIGS. 13 and 14. The advantages of this embodiment are also considered self evident from the description of the previous embodiments.

Sixth Form

The device shown in FIGS. 15 through 19 differs from all the foregoing embodiments in having no eraser but only a magnetic eraser dust collector built on the fundamental principles of the invention. Generally designated 30*e*, the eraser dust collector comprises an elongate, flat permanent magnet 34*e*, a shield 36*e* in the form of an elongate box for slidably receiving the magnet, and a magnet holder 66 rigidly attached to one end of the magnet.

Molded of plastics material, the boxlike shield 36*e* has at least one end open to allow the magnet 34*e* to slide into and out of the same, although both ends of the shield are shown to be open in this particular embodiment. The shield 36*e* has one of its larger elongate sides intended to serve as the required dust collecting wall 40*e*. The dust collecting wall has a pair of opposed marginal rims 54*e* extending longitudinally to define a groovelike space 56*e* for accommodating the collected eraser dust 46. The thickness of the dust collecting wall 40*e* and the depth of the space 56*e* must of course be determined in relation to each other so as to allow the maget 34*e* to attract the eraser dust therethrough.

The eraser holder 66, also of plastics material, has one end of the magnet 34*e* firmly embedded therein. When the magnet 34*e* is fully received in the shield 36*e* to occupy the working position as best seen in FIG. 17, the magnet holder 66 butts on one of the open ends of the shield, bounding one end of the groovelike space 56*e* defined by the rims 54*e*.

Figure 17:
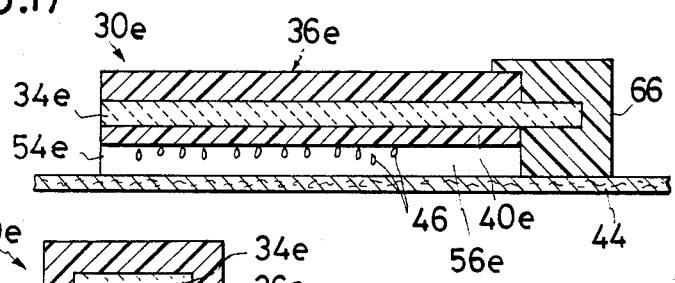
FIG. 17 is a longitudinal section through the dust collector of FIG. 15, taken along the line XVII—XVII of FIG. 16, the view being explanatory of the way the device collects magnetic eraser dust.
Figure 18:
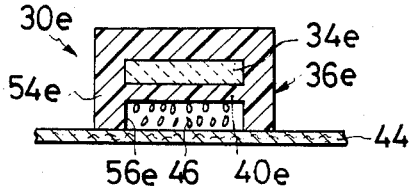
FIG. 18 is a transverse ection through the dust collector of FIG. 15, taken along the line XVIII—XVIII of FIG. 16.
Figure 19:
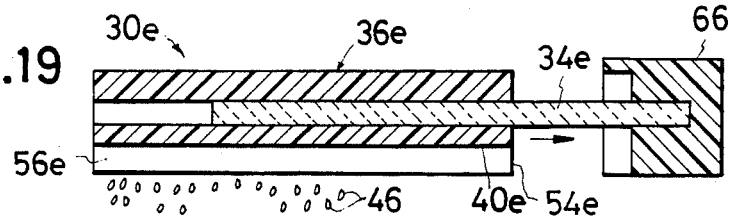
FIG. 19 is a view similar to FIG. 17 but explanatory of the way the device releases the collected eraser dust.

For collecting the magnetic eraser dust particles 46 the dust collector 30*e* may be placed on the desired surface 44, with the magnet 34*e* fully received in the shield 36*e* and with the dust collecting wall 40*e* directed downwardly, as illustrated in FIGS. 17 and 18. The eraser dust will attach to the dust collecting wall 40*e* by magnetic attraction as the dust collector is moved over the surface. Then, as illustrated in FIG. 19, the magnet 34*e* may be slid out of the shield 36*e*, by gripping the magnet holder 66, for releasing the collected eraser dust.

It is to be noted that the magnet 34*e* is moved between the working and retracted positions relative to the shield 36*e* in a direction parallel to the dust collecting wall 40*e*. In all the previous embodiments the direction of movement of the magnet relative to the shield is normal to the dust collecting wall. The dust collector 30*e* can collect and release eraser dust as effectively as the eraser/dust collector combinations 30 through 30*d* disclosed above. As an additional advantage, since the elongate magnet 34*e* has one of its broad surfaces held directly against the dust collecting wall 40*e* of corresponding shape and size, the device can collect dust very efficiently.

Seventh Form

The embodiment of FIGS. 20 through 23 also include no eraser. The eraser dust collector 30*f* of this embodiment features a magnet housing 68 in the shape of an elongate box of plastics material which is closed at both ends. The magnet housing 68 has fixedly mounted therein an elongate permanent magnet 34*f* held flatwise against one of the elongate sides of the housing, a piece of magnetic material 62*f* directly overlying the magnet to substantially increase its thickness, and another permanent magnet 70 of smaller size held against one end of the housing for a purpose yet to be described. The other end of the magnet housing 68 is flanged at 72.

The magnet housing 68 is slidably received in a shield 36*f* which also is in the shape of an elongate box, with one end closed and another end open. The flange 72 of the magnet housing 68 comes into abutment against the open end of the shield 36*f* when the magnet housing is fully received into the working position therein as in FIGS. 20 and 21. A piece of magnetic material 52*f* is secured to the inside surface of the closed end of the shield 36*f*. This magnetic piece 52*f* coacts with the smaller magnet 70 within the magnet housing 68 to positively hold the latter fully received in the shield of 36*f*.

The dust collector 30*f* further features the location of a rectangular set of rims 54*f* defining a dust accommodating space 56*f* on the dust collecting wall 40*f* of the shield 36*f*, the dust collecting wall being one of the elongate sides of the shield. The dust collecting space 56*f* is arranged some distance from the open end of the shield 36*f* to prevent the collected eraser dust from moving toward the open end of the shield when the magnet housing 68 is being pulled out of the shield. It will also be noted from FIG. 21 that the magnet 34*f* is so sized and arranged in the magnet housing 68 as to attract eraser dust only into the space 56*f* when in the working position in the shield 36*f*.

Figure 20:
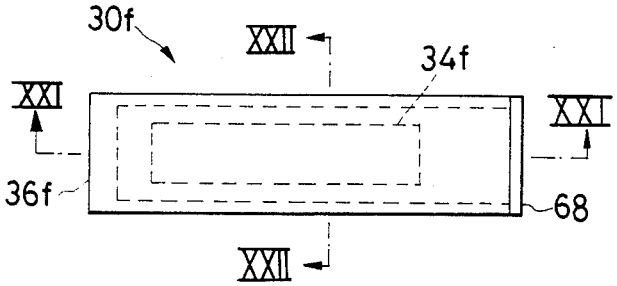
FIG. 20 is an elevation of another preferred form of the magnetic eraser dust collector, also not including an eraser, constructed in accordance with the principles of the invention.
Figure 21:
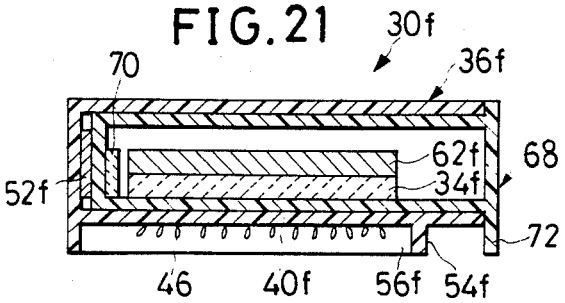
FIG. 21 is a longitudinal section through the dust collector of FIG. 20, taken along the line XXI—XXI therein, the view bieng explanatory of the way the device collects magnetic eraser dust.
Figure 22:
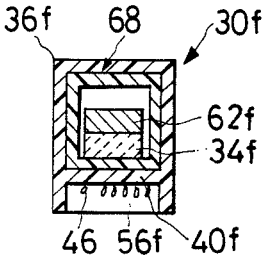
FIG. 22 is a transverse section through the dust collector of FIG. 20, taken along the line XXII—XXII therein.

In the use of the dust collector 30*f* the magnet housing 68 is fully inserted into the shield 36*f*, as shown in FIGS. 20 and 21, for dust collection. The magnet 70 within the magnet housing 68 attracts the magnetic piece 52*f* on the shield 36 upon full insertion of the magnet housing into the shield, so that the magnetic housing can be positively retained in the shield. As the dust collector 30*f* is subsequently moved over the desired surface, the magnet 34*f* will attract the magnetic eraser dust particles 46 through the magnet housing 68 and dust collecting wall 40*f*. The attracted eraser dust particles 46 will adhere to that part of the dust collecting wall 40*f* which is surrounded by the set of rims 54*f*.

Figure 23:
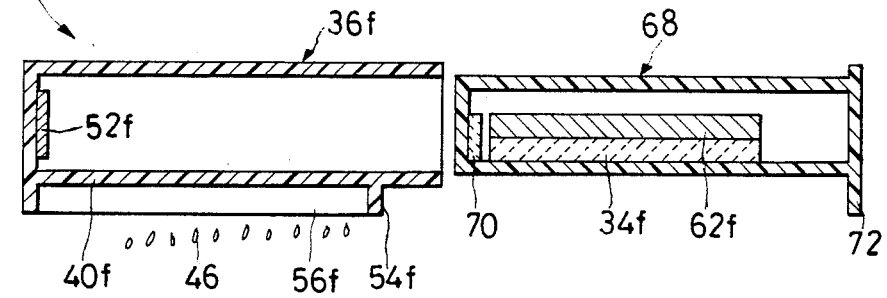
FIG. 23 is a view similar to FIG. 21 but explanatory of the way the device releases the collected eraser dust.

For releasing the collected eraser dust the magnet housing 68 may be pulled out of the shield 36*f*, as pictured in FIG. 23, by holding the flange 72. Although most of the eraser dust particles 46 will fall from the dust collecting wall 40*f* upon withdrawal of the magnet housing 68 from the shield 36*f*, some may move toward the open end of the shield 36*f* with the movement of the magnet housing. However, the rims 54*f* on the dust collecting wall 40*f* will limit such movement of the dust particles, preventing their attachment to the magnet housing 68.

The dust collector 30*f* has the following advantages, in addition to those of the dust collector 30*e*:

1. The collected eraser dust is effectively prevented from movement into attachment to the magnet housing 68 during the withdrawal thereof from the sheild 36*f*.

2. The magnet housing 68 can be positively retained in position within the shield 36*f* by the permanent magnet 70 and magnetic piece 52*f*.

3. The permanent magnet 34*f* is fully enclosed to avoid direct attachment of eraser dust thereto. Any dust that has attched accidentally to the magnet housing 68 is easier to remove than if it has attached directly to the magnet itself.

4. The magnet 34 has its thickness substantially augmented by the overlying magnetic piece 62*f*, so that its attractive force suffers little from the demagnetizing force.

Modifications

Figure 24:
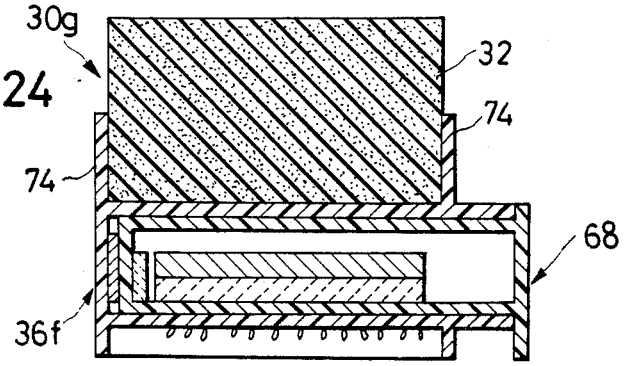
FIG. 24 is a section through a slight modification of the device of FIGS. 20 through 23, additionally comprising a magnetic eraser to provide a further example of eraser/dust collector combination in accordance with the invention.

FIG. 24 shows a modified eraser/duct collector combination 30*g*, which in essence in the combination of the dust collector 30*f* of FIGS. 20 through 23 with the magnetic eraser 32. A rectangular arrangement of walls 74 are formed on the boxlike shield 36*f* having the magnet housing 68 slidably mounted therein. The eraser 32 is retained on the shield 36*f* by the walls 74. Further details in the construction and operation of this eraser/-dust collector combination 30*g*, as well as the advantages thereof, will be apparent from the foregoing.

Figure 25:
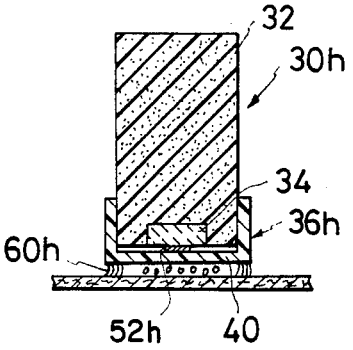
FIG. 25 is a longitudinal section through a possible modification of the eraser/dust collector combination in accordance with the invention.

Another modified eraser/dust collector combination 30*h* of FIG. 25 has a brush 60*h* arranged along the marginal edges of the dust collecting wall 40 of a shield 36*h*. This shield has no rims bounding a dust accommodating space, such rims being replaced by the brush. Further in this embodiment the magnet 34 is embedded in the eraser 32, and this eraser magnet assembly is removably engaged in the shield 36*h*. The magnet 34 is held against a piece of magnetic material 52*h* mounted centrally on the inner surface of the dust collecting wall 40 of the shield.

The present invention admits of various other modifications of the embodiments disclosed herein. The following is a brief list of such possible modifications:

1. Not only the third (FIG. 9) but also all the other embodiments disclosed herein may incorporate brushes.

2. The eraser and the permanent magnet may be combined solely by virtue of magnetic attraction therebetween in the first (FIGS. 1 through 4), third (FIG. 9) and fifth (FIGS. 13 and 14) embodiments.

3. In the sixth embodiment (FIGS. 15 through 19) an eraser may be engaged in the groovelike space 56*e* between the rims 54*e* and may be removed for dust collection.

4. In the sixth and seventh (FIGS. 20 through 23) embodiment a series of smaller permanent magnets may be substituted for the elongate magnet.

What is claimed is:

1. A device for collecting magnetic eraser dust comprising a permanent magnet for attracting magnetic eraser dust, a shield normally enclosing the permanent magnet to prevent direct adhesion of the eraser dust thereto and including a dust collecting wall having a thickness allowing the permanent magnet to attract the eraser dust therethrough, the permanent magnet being movable relative to the shield between a working position for attracting the eraser dust through the dust collecting wall of the shield, with the consequent adhesion of the eraser dust to the dust collecting wall of the shield, and a retracted position away from the dust collecting wall for releasing the collected eraser dust therefrom, and an eraser of a rubber composition having magnetic particles uniformly dispersed therein, the eraser being attached to the permanent magnet so as to at least partly project outwardly from the shield.

2. The device of claim 1 wherein the shield is in the form of a box, with one end closed and another end open, and the dust collecting wall of the shield is the closed end of the box.

3. The device of claim 1 further comprising a piece of magnetic material immovably attached to an inner surface of the dust collecting wall of the shield for firmly retaining the permanent magnet in the working position with respect to the shield, the permanent magnet attracting eraser dust through the magnetic piece when in the working position.

4. The device of claim 1 further comprising a piece of magnetic material immovably attached to an inner surface of the dust collecting wall of the shield for firmly retaining the permanent magnet, together with the eraser attached thereto, in the working position with respect to the shield, the permanent magnet attracting eraser dust through the magnetic piece when in the working position.

5. The device of claim 1 further comprising a piece of magnetic material attached directly to the permanent magnet.

6. The device of claim 1 wherein the shield is formed to include rims projecting from marginal edges of the dust collecting wall thereof, the rims bounding a space for accommodating the collected eraser dust.

7. The device of claim 1 further comprising a brush mounted exteriorly of the shield to facilitate the collection of eraser dust.

8. A device for collecting magnetic eraser dust comprising a permanent magnet for attracting magnetic eraser dust; a shield normally enclosing the permanent magnet to prevent direct adhesion of the eraser dust thereto and including a dust collecting wall having a thickness allowing the permanent magnet to attract the eraser dust therethrough, the permanent magnet being movable relative to the shield between a working position for attracting the eraser dust through the dust collecting wall of the shield, with the consequent adhesion of the eraser dust to the dust collecting wall of the shield, and a retracted position away from the dust collecting wall for releasing the collected eraser dust therefrom; an eraser of a rubber composition having magnetic particles uniformly dispersed therein; and an eraser holder enclosing part of the eraser and slidably received in the shield so as to leave the eraser projecting therefrom, the permanent magnet having attached to the eraser holder for joint movement therewith and with the eraser between the working and retracted positions relative to the shield.

9. The device of claim 8 further comprising a piece of magnetic material immovably attached to an inner surface of the dust collecting wall of the shield for firmly retaining the permanent magnet, together with the eraser attached thereto via the eraser holder, in the working position with respect to the shield, the permanent magnet attracting eraser dust through the magnetic piece when in the working position.

10. The device of claim 8 wherein the permanent magnet is mounted exteriorly of the eraser holder.

11. The device of claim 8 wherein the permanent magnet is mounted interiorly of the eraser holder.

12. The device of claim 8 wherein the eraser is movable relative to the eraser holder.

13. The device of claim 8 wherein the shield is in the form of a box, with one end closed and another end open, and the dust collecting wall of the shield is the closed end of the box.

14. The device of claim 8 wherein the shield is formed to include rims projecting from marginal edges of the dust collecting wall thereof, the rims bounding a space for accommodating the collected eraser dust.

15. The device of claim 8 further comprising a brush mounted exteriorly of the shield to facilitate the collection of eraser dust.

* * * * *

UNITED STATES PATENT AND TRADEMARK OFFICE

CERTIFICATE OF CORRECTION

PATENT NO. : 4,554,703

DATED : November 26, 1985

INVENTOR(S) : Shouzo Matuki

It is certified that error appears in the above-identified patent and that said Letters Patent is hereby corrected as shown below:

Column 1, line 64, "invnention" should read --invention--.

Column 2, line 15, after "eraser/" delete -- - --.

line 26, after "eraser/" delete -- - --.

line 54, after "perspective" insert --a preferred--.

line 64, delete "ection" and insert --section--.

Column 3, line 7, delete "bieng" and insert --being--.

Column 4, line 11, delete "walls" and insert --wall--.

Column 5, line 1, after "eraser/" delete -- - --.

line 4, after "eraser/" delete -- - --.

Column 6, line 12, after "eraser/" delete -- - --.

Column 7, line 63, delete "include" and insert --includes--.

Column 8, line 60, delete "sheild" and insert --shield--.

UNITED STATES PATENT AND TRADEMARK OFFICE

CERTIFICATE OF CORRECTION

PATENT NO. : 4,554,703

DATED : November 26, 1985

INVENTOR(S) : Shouzo Matuki

It is certified that error appears in the above-identified patent and that said Letters Patent is hereby corrected as shown below:

Column 9, line 6, delete "duct" and insert --dust--.

line 7, delete "in" second occurrence, and insert --is--.

line 14, after "eraser/" delete -- - --.

Column 10, line 39, delete "having" and insert --being--.

Signed and Sealed this

*Twenty-fourth* Day of *June 1986*

[SEAL]

*Attest:*

DONALD J. QUIGG

*Attesting Officer*

*Commissioner of Patents and Trademarks*